United States Patent [19]

Lawrence

[11] 4,116,514

[45] Sep. 26, 1978

[54] SECURITY HINGE

[75] Inventor: Tom M. Lawrence, Janesville, Wis.

[73] Assignee: Lawrence Brothers, Inc., Sterling, Ill.

[21] Appl. No.: 817,984

[22] Filed: Jul. 22, 1977

[51] Int. Cl.[2] ..... H01R 39/00

[52] U.S. Cl. ..... 339/4; 16/173

[58] Field of Search ..... 339/4; 16/173, 176, 16/149, 171, 128 R

[56] References Cited

U.S. PATENT DOCUMENTS

| | | | |
|---|---|---|---|
| 2,207,836 | 7/1940 | Sundell | 16/149 |
| 3,842,386 | 10/1974 | Suska | 339/4 |

*Primary Examiner*—Roy Lake
*Assistant Examiner*—DeWalden W. Jones
*Attorney, Agent, or Firm*—Olson, Trexler, Wolters, Bushnell & Fosse, Ltd.

[57] ABSTRACT

A security hinge is disclosed which includes a pair of leaves, having respectively, at least a pair of spaced end knuckles and at least one immediate knuckle disposed therebetween. Each knuckle includes a central axial bore, the bores being aligned co-axially. A pair of pins are provided, each pin having a head portion disposed in an end knuckle bore for rotation in unison therewith and a body portion thereof disposed within an intermediate knuckle bore to maintain the leaves in assembly and permit relative rotation therebetween the pin and intermediate knuckle. Stop means, are provided interiorly of the bores, against which the heads of the respective pins abut, thus preventing the pins from being driven completely through the end knuckle bores in the axially inward direction. Since the pins are recessed within the bores, and one prevents the other from being forced out of the bores in the axially outward direction, unauthorized disassembly of the hinge is precluded. The hinge may be provided with continuous passage means into which one or more electrical conductors are engaged, so that said conductor is substantially concealed, the hinge giving the outward appearance of a conventional, load bearing hinge.

21 Claims, 7 Drawing Figures

FIG. 1
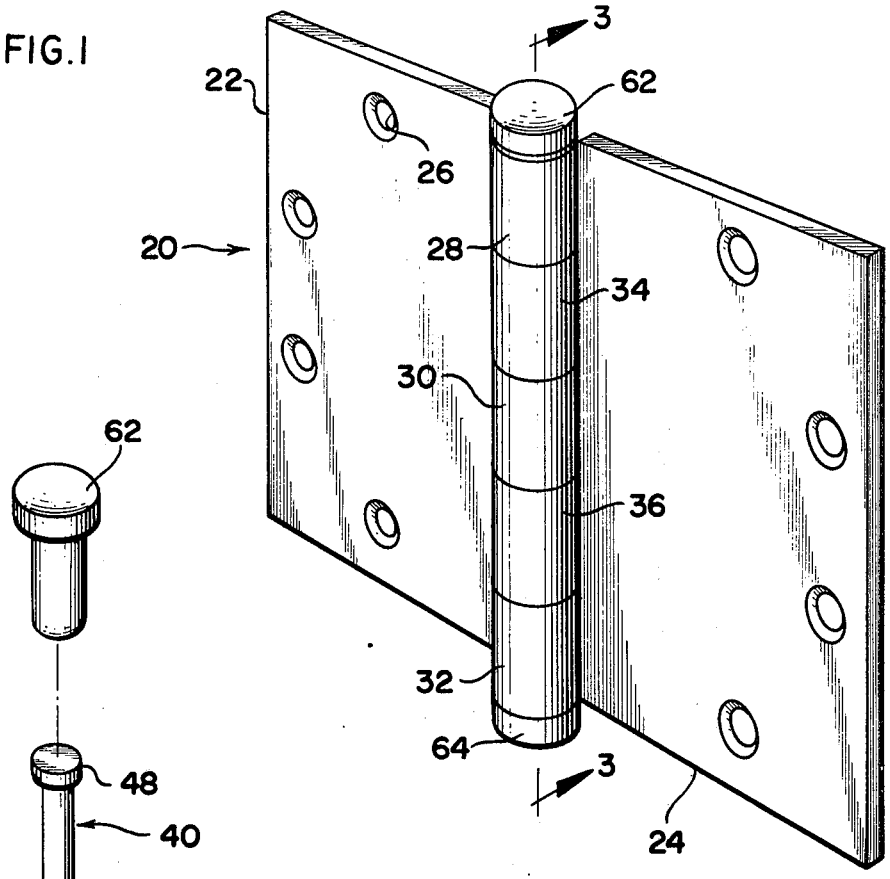
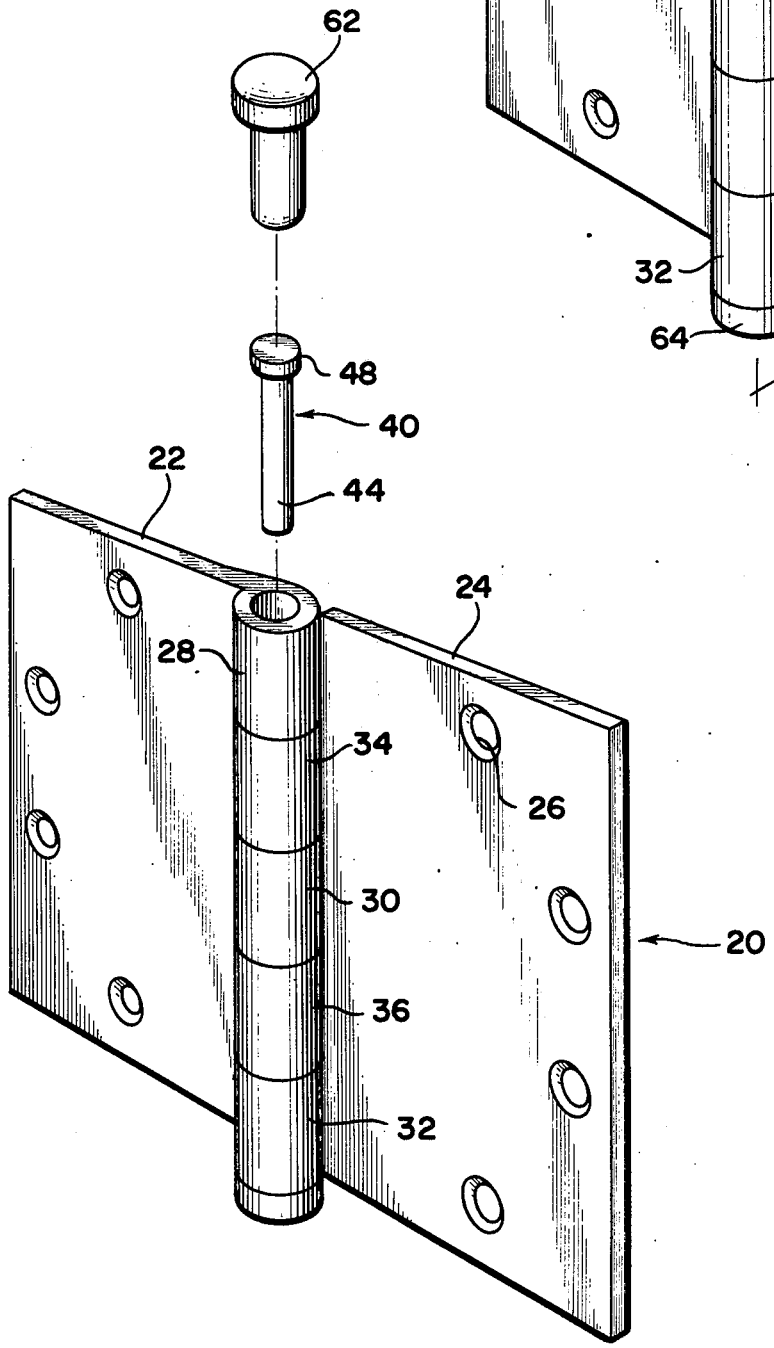
FIG. 2

SECURITY HINGE

BACKGROUND OF THE INVENTION

The present invention relates in general to hinges and, more particularly, to a hinge so constructed that a hinge pin thereof once inserted, cannot be driven out. Further, and also more particularly, this invention relates to a hinge constructed as described which further includes a concealed and tamper-proof conductor extending through a passage way formed therefor in the hinge.

In order to provide increased security for the exterior doors of offices, commercial and residential buildings, it is desirable to provide a security hinge which, once assembled and installed on the door, is difficult or impossible to dismantle by an intruder. This is especially true in the case of doors wherein leaf and knuckle type hinges are used, the knuckles thereof being exposed on one side of the door.

Leaf and knuckle type hinges are well known in the art and commonly comprise a pair of generally flat leaves attached to the door and the door frame, respectively. Each leaf includes one or more spaced apart knuckles which interfit with the knuckles of the opposite leaf, the knuckles each including a central axial bore, which bores are aligned coaxially with a pin or a pintle member, engaged therein to maintain assembly of the hinge parts. Arrangements known in the prior art include a pintle fitted inside of the aligned bores of the knuckles and an end cap provided at either end to enclose the knuckle bores and pintle, or pins attached to one or both of the end caps and extending through the aligned knuckle bores. In both cases it is a relatively simple matter to dismantle a hinge whose knuckles are exposed, by removing one of the end caps and driving out the pin or pintle by using a rod or the like, or by taking hold of an end cap with pliers or the like and forcibly pulling out the end cap and attached pin.

Additional security is also provided for many doors by the use of an electrically operated lock or by the use of an electrical system to monitor the door and energize a suitable alarm when the door is opened or when the lock is not properly engaged. It is necessary in either of the above applications to provide for the completion of an electrical circuit including a suitable conductor between the door frame and the door. Hinges adapted for the establishment of an electrical circuit between the door and door frame are known, as for example in U.S. Pat. Nos. 3,838,234; 3,842,386 and 3,857,625.

The prior art hinges while suited for the establishment of an electrical circuit, are not tamper-proof, and once detected, can easily be disassembled so that access to the conductors can be had and the security system compromised.

Accordingly, it is an object of the present invention to provide a new and improved hinge structure which provides maximum security in that the hinge structure is difficult, if not impossible to disassemble quickly once assembled.

Another object of the present invention is to provide a hinge structure in accordance with the foregoing object which includes means forming an electrically conductive path through the hinge structure.

Briefly, and in accordance with the foregoing objects, the present invention provides a security hinge comprising a pair of leaves, one of said leaves including at least a pair of spaced end knuckles and the other of said leaves including at least one intermediate knuckle positioned between the end knuckles. The end and intermediate knuckles each include a central axis bore, the bores being aligned coaxially. Pin means are disposed inside of the bore of at least one of said end knuckles for rotation and unison therewith, and extending into the bore of the intermediate knuckle. Stop means are provided for preventing the pin means from being driven completely through the end knuckle bore in the axially inward direction. Further, additional means preferably in the form of a second pin means is disposed in the opposite end of the bore preventing removal of said first pin means in the axially outer direction.

In a preferred embodiment, the maximum security hinge also includes conductor means and passage means formed in the hinge for housing and concealing from view conductor means passing through the hinge.

The foregoing, as well as other objects, features and advantages of the invention will be appreciated upon consideration of the following detailed description together with the accompanying drawings wherein like reference numerals are used throughout to indicate like elements and components.

DESCRIPTION OF THE DRAWINGS

FIG. 1 is a perspective view of an assembled maximum security hinge according to the invention;

FIG. 2 is a partially exploded view of the hinge of FIG. 1 revealing additional details thereof;

DETAILED DESCRIPTION OF THE ILLUSTRATED EMBODIMENT

Figure 3:
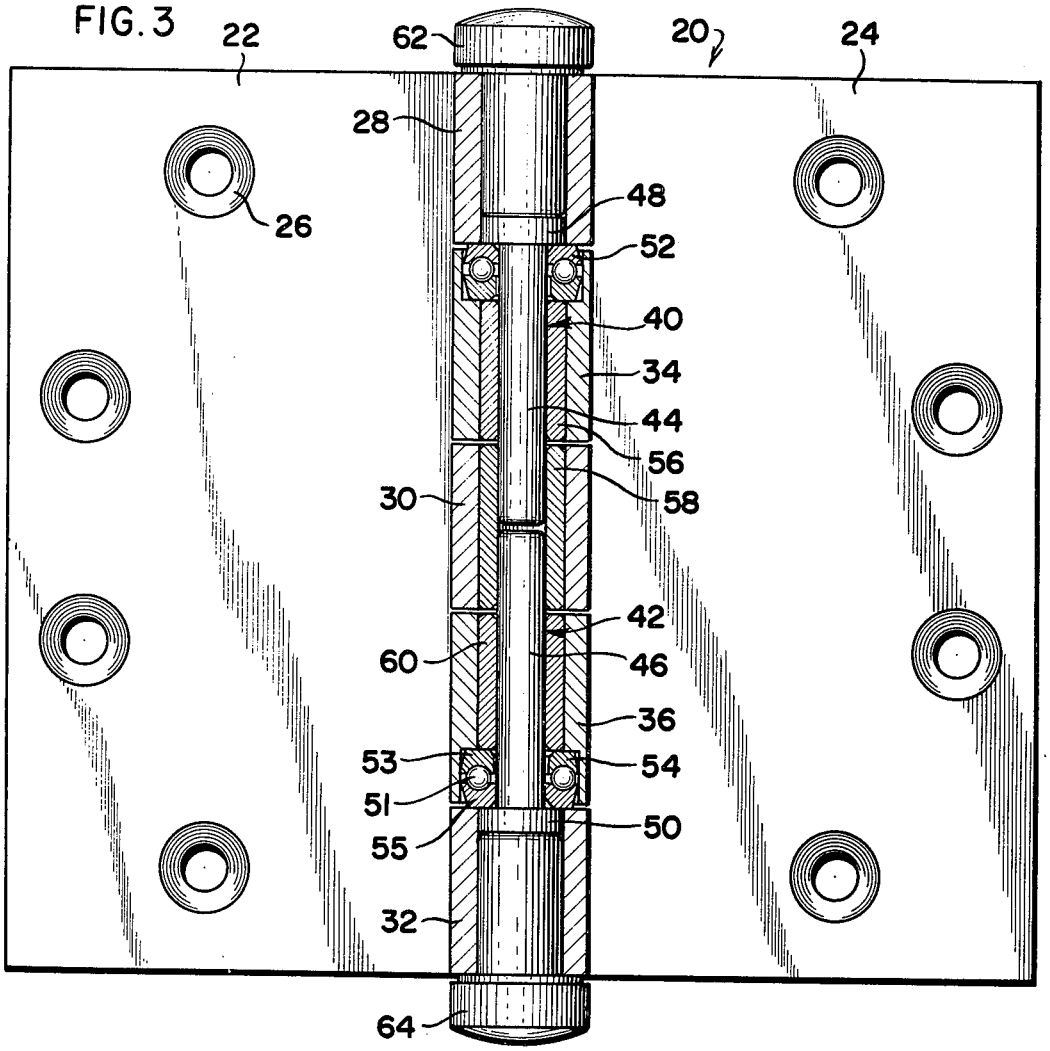
FIG. 3 is an enlarged, partial sectional view taken generally along the lines 3—3 of FIG. 1.
Figure 4:
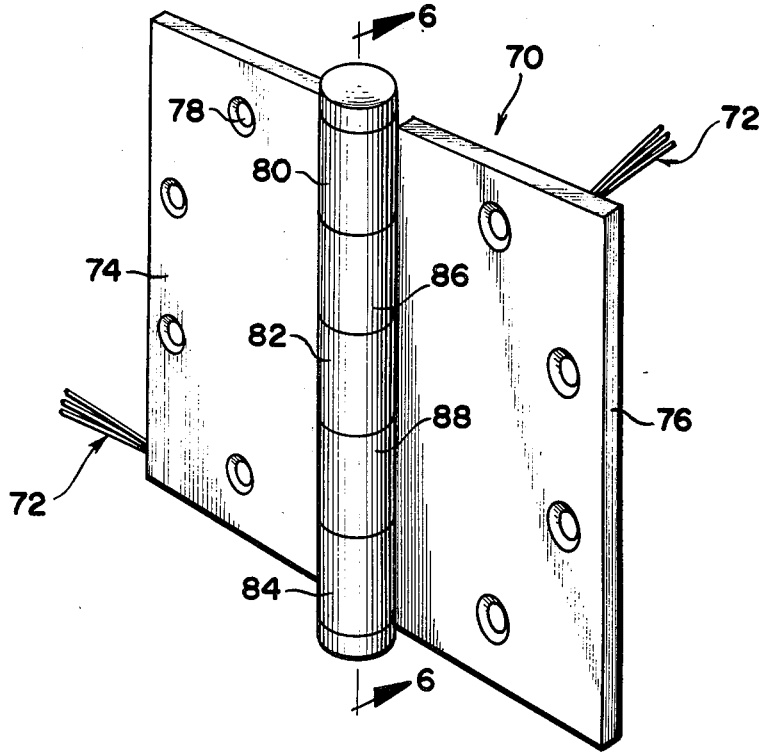
FIG. 4 is a perspective view of a maximum security hinge including a concealed and tamper-proof conductor, in accordance with the invention.
Figure 5:
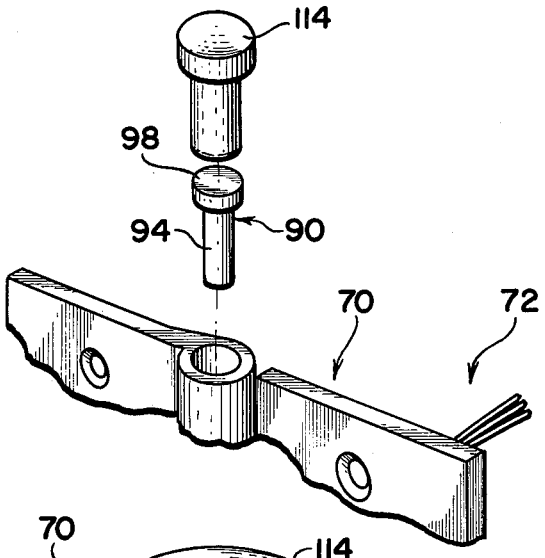
FIG. 5 is a view of a portion of FIG. 4, partially exploded to reveal additional details thereof.

Referring now to FIGS. 1 through 3, a security hinge designated generally 20 includes a pair of leaves 22, 24 which are generally rectangular in shape and of uniform thickness. Each leaf includes a plurality of suitable mounting holes or apertures 26 for receiving mounting screws or the like for attachment of the hinge to a door and door frame. The hinge 20 of FIGS. 1 through 3 is of the five-knuckle type, the leaf 22 having three spaced apart knuckles 28, 30 and 32, and the leaf 24 having two spaced apart knuckles 34 and 36 which are arranged intermediate the end knuckles 28 and 32 and the central knuckle 30 of the leaf 22. Each of the knuckles 28 through 36 includes a central axial bore, the bores being aligned coaxially. Thus, the knuckles are axially aligned such that the insertion of suitable pins or the like, to be described in further detail below, maintain assembly and permit relative pivotal movement of the leaves 22 and 24 about a common axis. Although the illustrated embodiment includes five knuckles, it will be appreciated that the present invention is equally applicable to hinges having a different number of knuckles, as for example, three knuckles.

Pin means for the hinge 20 are best viewed in FIGS. 2 and 3, and comprises a pair of elongate pin members 38 and 40. The pin members have generally cylindrical elongate body portions 42 and 44 and somewhat larger diameter flanged head portions 48 and 50. In the assembled condition the head portions 48 and 50 are disposed inside or recessed with respect to the bores of the respective end knuckles 28 and 32 with the body portions 44 and 46 extending into the bores of the intermediate knuckles 34 and 36 and the bore of the central knuckle 30 to hold the leaves 22 and 24 in assembly.

Stop means are provided for preventing the pins 40 and 42 from being driven completely through the bores of the respective end knuckles 28 and 32 in an axially inward direction. In the illustrated embodiment said stop means are provided by a pair of thrust bearing assemblies 52, 54 disposed between the respective end knuckles 28, 32 and the adjacent intermediate knuckles 34 and 36. In addition generally tubular bearing sleeves 56, 58 and 60 are disposed inside of the bores of the intermediate knuckles 34 and 36 and central knuckle 30 to receive and provide radial support to the body portions 44, 46 of the pins 40, 42. A pair of end caps 62 and 64 are provided, disposed in the respective bores of the end knuckles 28 and 32 axially outwardly of the pins 40 and 42, so that the end knuckles 28, 32 the pins 40, 42 and the end caps 62, 64 rotate in unison. Although button-tip type end caps 62 and 64 are illustrated, it is to be understood that flush-tip type end caps may also be used.

Thrust bearing assemblies 52, 54 are of conventional design and are seated in axially facing recesses provided in the intermediate knuckles 34, 36 and have their axially outer ends extending slightly outwardly of the bores toward the respective end knuckles 28, 32 and the heads 48, 50 of the pins 40, 42, both of which engage said assemblies. Thus the thrust bearings 52 and 54, in addition to providing increased load handling capabilities and maintaining smooth operation thereof under loaded conditions, also provide the stop means for the pins 40 and 42. Since the central openings in the generally annular thrust bearings 52, 54 are of smaller diameter than the heads 48, 50 on pins 40, 42, the pins cannot be driven in the axially inner direction once the hinge structure is assembled. While the respective pins 44 and 46 are movable in the opposite direction, i.e. axially outer, the presence of pin 44 prevents removal of pin 46, and correspondingly, pin 46 prevents removal of pin 44. Also the head portions 48 and 50 may be press fitted within the bores of knuckles 28 and 32. Thus, it is extremely difficult if not impossible for an intruder to dismantle the hinge structure 20 once assembled.

Referring now to FIGS. 4 through 7, a hinge structure 70, substantially similar to the hinge structure 20 of FIGS. 1 through 3 is illustrated, which structure includes a concealed and tamper-proof conductor 72 extending therethrough. The hinge 70 includes a pair of leaves 74, 76 having a plurality of suitable mounting holes 78 formed therein for attachment of the hinge 70 to a door and door frame, respectively. The leaf 74 includes three spaced-apart knuckles 80, 82 and 84, while leaf 76 includes two spaced-apart knuckles 86 and 88 which are arranged intermediate the end knuckles 80 and 84 and the central knuckle 82 of the leaf 74. Each of the knuckles 80 through 88 includes a central axial bore, the bores being aligned coaxially, such that the insertion of suitable pins, to be described below, maintains assembly and permits relative pivotal movement of the leaves 74 and 76 about a common axis.

Figure 6:
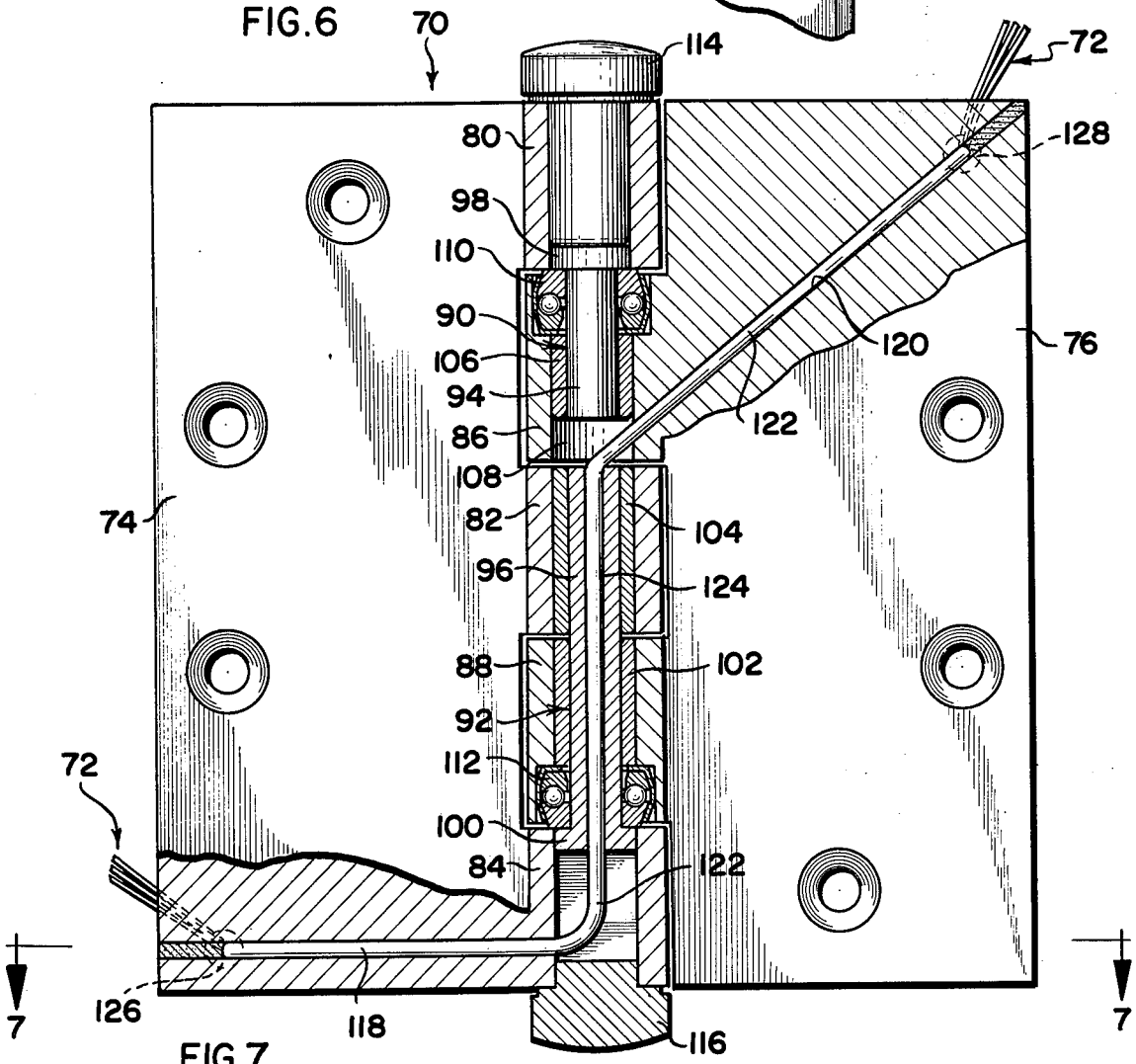
FIG. 6 is an enlarged view, taken generally along the lines 6—6 of FIG. 4.

The pin means for this embodiment of the invention are provided by a pair of elongate pins 90, 92 each including a generally cylindrical elongate body portion 94, 96 and a larger diameter disc-like head portion 98, 100 disposed axially outwardly of the respective body portion 94, 96, as best seen in FIG. 6. The head portions 98 and 100 of the pins 90 and 92 are disposed inside the bores of the respective end knuckles 80 and 84 and preferably press fitted therein for rotation and unison therewith. The body portion 96 of the pin 92 extends through the bores of the intermediate knuckle 88 and the central knuckle 82. Similarly, the body portion 94 of the pin 90 extends part way through the bore of the intermediate knuckle 86. Generally tubular bearing sleeves 102 and 104 are provided inside of the bores of the intermediate and central knuckles 88 and 82 and a similar bearing sleeve 106 is disposed inside of the bore of the intermediate knuckle 86. The bearing sleeves 102, 104 and 106 are of suitable dimensions to receive and provide radial support to the body portions 94 and 96 of the respective pins 90 and 92 and provide for relative rotation between the pins and the intermediate knuckles 86 and 88. Thus, the leaves 74 and 76 are rotatable with respect to one another about the common axis defined by the pins 90 and 92.

It will be noted that the sleeve bearing 106 is coextensive with the body portion 94 of the pin 90 within the bore of the intermediate knuckle 86, whereby an unoccupied portion or cavity 108 is defined within the bore of the knuckle 86. In other words, the pins 90 and 92 have spaced apart ends within the knuckles, the cavity 108 being defined by the spacing therebetween.

A pair of thrust bearings 110, 112 may be provided between the respective end knuckles 80, 84 and the adjacent intermediate knuckles 86 and 88, respectively. The thrust bearings 110 and 112 are seated in suitable portions of the bores of the intermediate knuckles 86 and 88 provided therefor, in the same fashion and for the same purpose as described above with regard to the thrust bearings 52 and 54 of FIG. 3. The bearings 110 and 112 provide stop means for preventing the respective pins 90 and 92 from being driven through the knuckles of the hinge, once inserted in their proper position therein. A pair of end caps 114 and 116 are provided, disposed in the respective bores of the end knuckles 80 and 84 axially outwardly of the pins 90 and 92, so that the end knuckles, pins and end caps rotate in unison. The end cap 114 is substantially identical to the end caps 62 and 64 of FIGS. 1 through 3, while the end cap 116 presents a substantially identical exterior appearance while the portion thereof disposed within the end knuckle 84 is formed somewhat differently, as will be described below.

Figure 7:
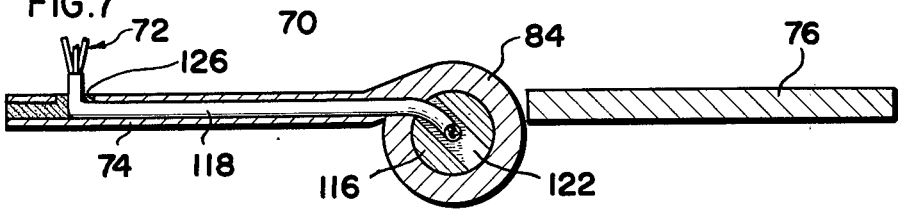
FIG. 7 is a view taken generally along the lines 7—7 of FIG. 6.

As will now be detailed, hinge 70 includes passage means extending therethrough for accommodating a conductor 72, as seen in FIGS. 6 and 7. In this regard, a first tunnel or passageway 118 is formed through the leaf 72 from the exterior edge thereof into the bore of the knuckle 84. The portion of the end cap 116 within the knuckle 84 includes a transverse slot or opening 122 formed therein, as best seen in FIG. 7, the end cap 116 being positioned within the knuckle 84 such that the slot 122 is in alignment with the opening of the tunnel or passageway 118 into the bore of the knuckle 84. As best seen in FIG. 6, the pin 92 includes a central axial bore or opening 124 extending lengthwise therethrough between the slot 122 of the end cap 116 and the cavity 108 provided in the knuckle 86. A second tunnel or passageway 120, similar to the tunnel 118 is formed in the leaf 76 extending from the edge thereof into the cavity 108 of the knuckle 86. Aperture or counter-bore 126 and 128 are drilled or otherwise formed in the rear surface of the leaves 74 and 76 extending perpendicularly to that surface and into the respective passageways or tunnels 118 or 120. It will be appreciated, then that the apertures 126 and 128, the passageways 118 and 120, slot 122, the pin bore 124, and the cavity 108 form a single continuous path or passageway for the conductor 72 through the hinge structure. Accordingly, due primarily to the use of the hollow pin 92 which accommodates the conductor 72, the leaves 74 and 76 can pivot with respect to each other without damage to conductor 72. Further, when assembled, the leaf faces of hinge 70 from which the connector 72 extends will be in contact with the door and door frame which are suitably recessed to accommodate said conductor 72, and said conductor 72 is concealed from view.

Accordingly, the hinge 70 provides means whereby an electric circuit can be established with components carried by the door and the nature of said hinge concealed. In addition, the construction of the pin means 92 and 94 for maintaining the hinge in the assembled condition, prevents disassembly and tampering with the conductor 72, should the true nature of the hinge be discovered.

While specific embodiments of preferred forms of the invention have been shown and described herein, various changes and modifications may be apparent to those skilled in the art once apprised of the present disclosure; and insofar as these modifications fall within the spirit and scope of the appended claims, they form part of the present invention.

The invention is claimed as follows:

1. A security hinge comprising a pair of leaves, one of said leaves including at least a pair of spaced end knuckles and the other of said leaves including at least one intermediate knuckle positioned between said end knuckles, said knuckles each including a central axial bore, said bores being aligned co-axially, a pin member disposed inside said bore of at least one of said end knuckles for rotation in unison therewith, and extending into said bore of said intermediate knuckle, stop means for preventing said pin member from being driven completely through said end knuckle bore, and means disposed in the bore of the other of said end knuckles to prevent said pin from being forced out of said one end knuckle, wherein said means includes a second pin member, such that one pin is associated with each of said end knuckles and each pin comprising a generally cylindrical body portion extending into said intermediate knuckle bore and an end portion of enlarged diameter disposed inside said bore of said end knuckle and engaged against said stop means to prevent further axially inward movement.

2. A security hinge according to claim 1 wherein said stop means is provided by a generally annular thrust bearing having a central opening of smaller diameter than said end portions of said pins disposed between each of said end knuckles and the adjacent intermediate knuckle, said body portion of each of said pins extending through said central opening of said thrust bearing and said end portion of each of said pins being disposed axially outwardly of each of said thrust bearings.

3. A security hinge according to claim 2 further including a generally tubular sleeve bearing disposed inside said bore of said intermediate knuckle to receive and provide radial support to said body portion of said pin so that said pin is rotatable with respect to said intermediate knuckle.

4. A security hinge according to claim 3 wherein said intermediate knuckle bore includes a first portion for receiving said sleeve bearing and a second portion axially outward of and of larger diameter than said first portion to receive said thrust bearing, so that said thrust bearing rests in said second portion, an axially outer end of said thrust bearing extending axially outwardly of said second portion toward said adjacent end knuckle and said end portion of said pin.

5. A security hinge for mounting a door to a door frame and for providing an electrically conductive path between said door and said door frame, said hinge comprising a pair of leaves, one of said leaves including at least a pair of spaced end knuckles and the other of said leaves including at least one intermediate knuckle means disposed between said end knuckles, said knuckles each including a central axial bore, said bores being aligned co-axially, a pin member disposed within each said end knuckle bore for rotation in unison therewith and extending at least into the bore of the knuckle means of the other leaf, stop means for preventing said pin means from being driven completely through said end knuckle bores, said pin member being recessed with respect to said end knuckles so that neither member may be driven out of said bores from the opposite direction, and concealed and tamper-proof conductor means for providing said electrically conductive path between said door and said door frame and passage means formed in said hinge for the passage of said conductor means therethrough.

6. A maximum security hinge according to claim 5 wherein each said pin member includes a generally cylindrical body portion extending into said intermediate knuckle and a disc-like end portion of larger diameter than said body portion disposed inside said bore of a respective one of said end knuckles, and engaged with said stop means.

7. A maximum security hinge according to claim 6 wherein said stop means includes a generally annular thrust bearing having a central opening of smaller diameter than said end portions of said pins disposed between each of said end knuckles and the adjacent intermediate knuckle, said body portion of each of said pins extending through said central opening of said thrust bearing and said end portion of each of said pins disposed axially outwardly of said thrust bearing.

8. A maximum security hinge according to claim 7 further including a pair of end caps disposed in the bores of said end knuckles axially outwardly of said pin member to rotate in unison therewith and with said end knuckles, said passage means including a tunnel in each of said leaves extending through a respective knuckle of each leaf to the central bore thereof, a first opening in one of said end caps, a second opening through one of said pins, said pins having spaced apart ends with in said knuckles to define a cavity, said first and second openings and said cavity defined by said spaced apart ends being aligned for connecting said tunnels.

9. A security hinge comprising a pair of leaves, one of said leaves including at least a pair of spaced apart end knuckles, the other of said leaves including at least one intermediate knuckle disposed between said end knuckles, and said knuckles each including a central axial bore, said bores being aligned co-axially, pin means disposed inside of said end knuckle bores and recessed with respect to the end surfaces thereof for rotation in unison therewith and extending into said intermediate knuckle, stop means for preventing said pin from being driven completely through said end knuckle bores, said pin means including a pair of pins each comprising a generally cylindrical body portion extending into said intermediate knuckle and a disc-like end portion of larger diameter than said body portion disposed inside of said end knuckle bore, and engaged with said stop means.

10. A maximum security hinge according to claim 9 wherein said stop means includes a generally annular thrust bearing having a central opening of smaller diameter than said end portions of said pin means disposed between each of said end knuckles and the adjacent intermediate knuckle, said body portion of said pin extending through said central opening and said end portion of said pin disposed axially outwardly of said thrust bearing.

11. A maximum security hinge according to claim 10 further including a generally tubular sleeve bearing disposed inside said bore of said intermediate knuckle, said sleeve bearings providing radial support for said body portions and further providing for rotation of said pins with respect to said intermediate knuckle.

12. A maximum security hinge according to claim 11 wherein said intermediate knuckle bores include first portions for receiving said sleeve bearings and second portions axially outward of and of larger diameter than said first portions to receive said thrust bearings, an axially outer end of each of said thrust bearings extending axially outwardly of said second bore portions toward said adjacent end knuckles and said end portions of said pins.

13. A security hinge comprising a pair of leaves, at least one knuckle formed on each said leaf, each knuckle including a central axial through bore with said knuckles being juxtaposed with their respective bores co-axially aligned, pin means disposed within said knuckles to maintain said knuckles in assembly, including a first pin member inserted through a first one of said knuckles in a first axial direction, and a second pin member inserted through the second knuckle in a second axial direction, stop means associated with said pin members for positively precluding said pin members from being driven completely through said knuckle bores in the direction of their respective insertions, and both said pin members being disposed entirely within said knuckles, thereby providing a tamper-proof hinge construction.

14. A security hinge according to claim 13, wherein each said pin member includes an enlarged head portion, and a body portion, with said head portion of each pin engaging the associated stop means.

15. A security hinge according to claim 14, wherein said stop means includes at least one generally annular thrust bearing having a central opening of smaller diameter than the enlarged portion of the pin member engaged therewith, said bearing being disposed between the respective knuckles, with the body portion of the associated pin extending through said central opening therein.

16. A security hinge according to claim 13, wherein one of said leaves includes at least a pair of spaced end knuckles and the other of said leaves including at least one intermediate knuckle positioned between said end knuckles.

17. A security hinge according to claim 13, wherein one of said leaves includes at least a pair of spaced end knuckles, and a central knuckle spaced apart from each of said end knuckles and disposed substantially centrally therebetween, the other of said leaves including at least a pair of spaced apart intermediate knuckles, such that when in assembly said intermediate knuckle of said other leaf are interleaved with the end and central knuckles of said one leaf.

18. A maximum security hinge according to claim 13 further including conductor means and passage means for the passage of said conductor means through said hinge, with end caps closing said bores at said end knuckles.

19. A security hinge according to claim 18 wherein said passage means includes a bore formed in said one leaf and opening to the central bore of an end knuckle thereof, a bore formed in said other leaf opening to the bore of said intermediate knuckle, the end caps disposed in said end knuckle including an elongate slot aligned with said bore in said one leaf, the said pin member being disposed adjacent said end cap and including a central bore aligned with said slot, and said pin means extending at least to said intermediate knuckle, thereby providing passage means for said conductor.

20. A load bearing hinge for mounting a door in a door frame and for providing an electrically conductive path between said door and said door frame comprising a pair of leaves, one of said leaves including a pair of spaced apart end knuckles and the other of said leaves including at least one intermediate knuckle disposed between said end knuckles, said knuckles each including a central axial bore, said bores being aligned co-axially with pin means disposed inside of said bores to maintain assembly, first passage means formed in said one leaf opening to the bore of one of said end knuckles, second passage means formed in the other of said leaves and opening to said at least one intermediate knuckle, an end cap disposed in the bore of said one end knuckle and including recess means aligned with said first passage, said pin means including a central bore and extending along said central axial bore to a location proximate said juncture of said second passage with said central bore, and continuous conductor means passing through said first passage into said end cap recess means, and from there along said pin means bore to said second passage means wherein said conductor is concealed from view and housed in a tamper-proof manner.

21. A hinge according to claim 20 wherein said pin means include a pair of pin members, one of which includes said bore for receiving said conductor, each said pin members including an enlarged head portion received and recessed within the associated end knuckle from the open end thereof, stop means against which said head portions engage to prevent further movement along said bore in the axial inward direction, with the presence of one pin preventing the other from being driven out of said bore in the axially outward direction.

* * * * *